US009472031B2

(12) United States Patent
Pouille

(10) Patent No.: US 9,472,031 B2
(45) Date of Patent: Oct. 18, 2016

(54) SECURITY KIOSK AND SYSTEM AND METHOD OF CONTROLLING ACCESS USING THEREOF

(71) Applicant: Olivier Pouille, Riviera Beach, FL (US)

(72) Inventor: Olivier Pouille, Riviera Beach, FL (US)

( * ) Notice: Subject to any disclaimer, the term of this patent is extended or adjusted under 35 U.S.C. 154(b) by 0 days.

(21) Appl. No.: 14/528,861

(22) Filed: Oct. 30, 2014

(65) Prior Publication Data

US 2016/0125676 A1 May 5, 2016

(51) Int. Cl.
*G07C 9/00* (2006.01)

(52) U.S. Cl.
CPC ..... *G07C 9/00031* (2013.01)

(58) Field of Classification Search
CPC G07C 9/00; G07C 9/00134; G07C 9/00158; G06F 3/044; G06K 5/00
USPC ..... 340/5.7, 541, 5.65, 5.73, 540, 340/5.51–5.54, 5.2, 5.3, 568.1; 235/381, 235/382
See application file for complete search history.

(56) References Cited

U.S. PATENT DOCUMENTS

2006/0026283 A1* 2/2006 Trueba ..... G06F 21/577 709/225
2013/0292467 A1* 11/2013 Avs ..... G07C 9/00031 235/381

OTHER PUBLICATIONS

Envera Systems Website—http://www.enverasystems.com/virtual-gate-guard; printed Jun. 4, 2014.

* cited by examiner

*Primary Examiner* — Allen T Cao
(74) *Attorney, Agent, or Firm* — Shimokaji IP

(57) ABSTRACT

A security kiosk for controlling access to an area, includes a housing, a visitor identification reader, a data storage device, a controller, and a visitor interface device. The visitor identification reader is configured to read a visitor identifier and produce a visitor identification signal indicative of a visitor's identity. The data storage device is configured to store approved visitor data including approved visitors and corresponding date and time gate entry periods, and update the approved visitor data from a remote security database at periodic intervals. The controller is configured to generate an access signal as a function of comparing the visitor's identity with the approved visitor data, and transmit the access signal to a barrier actuation system. The visitor interface device is configured to produce and transmit a visitor signal inputted on a user interface.

2 Claims, 4 Drawing Sheets

SECURITY KIOSK AND SYSTEM AND METHOD OF CONTROLLING ACCESS USING THEREOF

BACKGROUND OF THE INVENTION

The present invention generally relates to security kiosks, systems, and methods to control access to an area.

Gated communities, condominiums, office buildings and parks, and other multi-unit and occupant areas may desire a security system to allow access only to occupants and their desired visitors. For example, a gated community or office part may have a guardhouse at a gate, and hire a security officer to only admit occupants or approved visitors. A condominium or office building may have a check-in desk and secure lobby with an attendant or security officer. Occupants may communicate to the security officer or attendant all approved visitors, along with the dates and times they are approved for access to the area.

Hiring a security officer or attendant may be expensive. Some systems have been developed utilizing virtual security officers who are located in a central location and monitor a gate and communicate with visitors through a camera, microphone, and speaker remotely. Although these may be less expensive than a security officer on-site, they may still be costly and communication may be slower, especially when the communication networks which are relied on have heavy traffic.

As can be seen, there may be an ongoing need to minimize the cost of systems to control access to an area while providing fast and accurate service to occupants and their visitors.

SUMMARY OF THE INVENTION

In one aspect of the present invention, a security kiosk for controlling access to an area comprises a housing; a visitor identification reader including a visitor identification placement area located on or near the housing, the reader configured to read a visitor identifier and produce an visitor identification signal indicative of a visitor's identity; a data storage device located at least partially in the housing and configured to store approved visitor data, and update the approved visitor data from a remote security database at periodic intervals, the approved visitor data including visitor identity and corresponding approved date and time gate entry periods; a controller communicatively connected to the visitor identification reader and the data storage device, and configured to generate an access signal as a function of comparing the visitor's identity with the approved visitor data, the controller located at least partially in the housing and configured to communicatively connect to a barrier actuation system to transmit the access signal to the barrier actuation system; and a visitor interface device including a user interface located on the housing exterior, the visitor interface device configured to produce and transmit a visitor signal inputted on the user interface.

In another aspect of the present invention, a method of controlling access to an area, comprises entering approved visitor data on an entry manager user interface, the approved visitor data including approved visitor identities and corresponding approved date and time barrier entry periods; periodically updating and storing in a storage device located in a security kiosk the approved visitor data; playing at least one of an audio and video welcome message on a visitor communication device in the security kiosk; scanning a visitor identifier with a visitor identification reader located in a security kiosk and generating a visitor identification signal indicative of a visitor's identity; comparing the visitor's identity with the approved visitor identities in the approved visitor data stored in the storage device and the present time and date with the corresponding approved date and time gate entry periods; generating an open barrier signal when the visitor identity and present time and date match data in the approved visitor data; and playing at least one of an audio and video entry status message on the visitor communication device.

In yet another aspect of the present invention, a security system for controlling access to an area, comprises an entry manager user interface configured to allow entry and updates of approved visitor data, the approved visitor data including approved visitor identities and corresponding approved time and date entry periods; an approved visitor data main database communicatively connected with the entry manager user interface and configured to store and update approved visitor data; an entrance barrier to allow or bar access through an entrance, the entrance barrier including an entrance barrier actuator, the entrance barrier actuator configured to open and close the entrance barrier to selectively allow or bar access through the entrance in response to an access signal; a security kiosk communicatively connected to the main database and the entrance barrier actuator, and including a housing including an exterior with a recess, a visitor identification reader located in the recess and configured to read a visitor identifier and produce an visitor identification signal indicative of a visitor's identity, a data storage device located at least partially in the housing and configured to store approved visitor data, and update the approved visitor data from the main database at periodic intervals, a controller communicatively connected to the visitor identification reader and the data storage device, and configured to generate an access signal as a function of comparing the visitor's identity with the approved visitor data, the controller located at least partially in the housing, and a visitor interface device including a user interface located on the housing exterior, the visitor interface device configured to produce and transmit a visitor signal inputted on the user interface.

These and other features, aspects and advantages of the present invention will become better understood with reference to the following drawings, description and claims.

DETAILED DESCRIPTION OF THE INVENTION

Figure 1A:
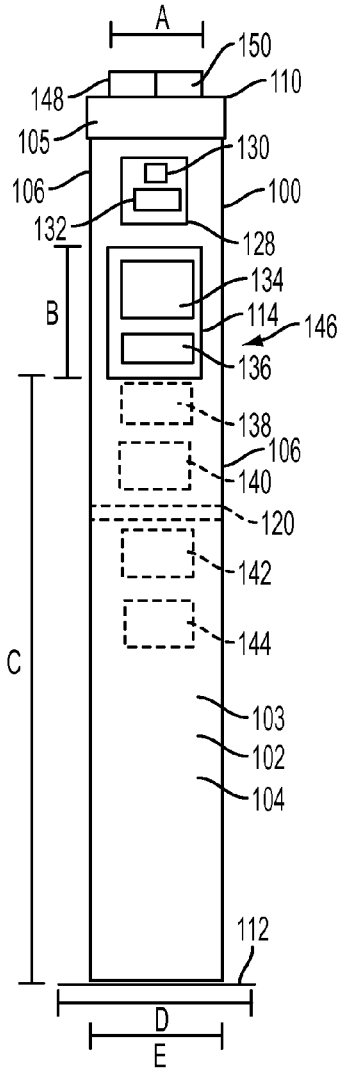
FIG. 1A is a front view of a security kiosk according to a first exemplary embodiment of the present invention.
Figure 1B:
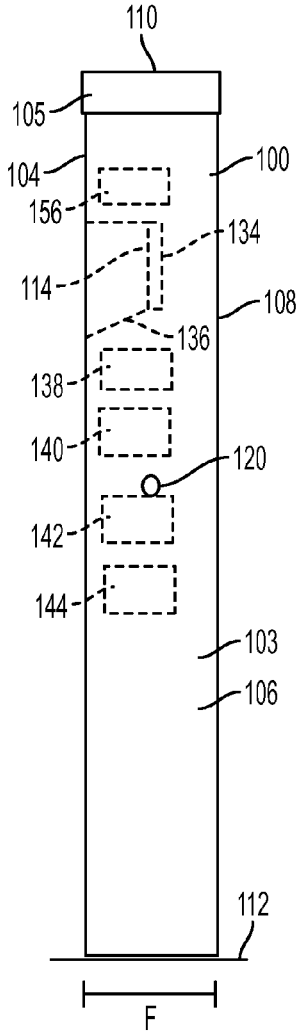
FIG. 1B is a side view of the security kiosk of FIG. 1A.
Figure 1C:
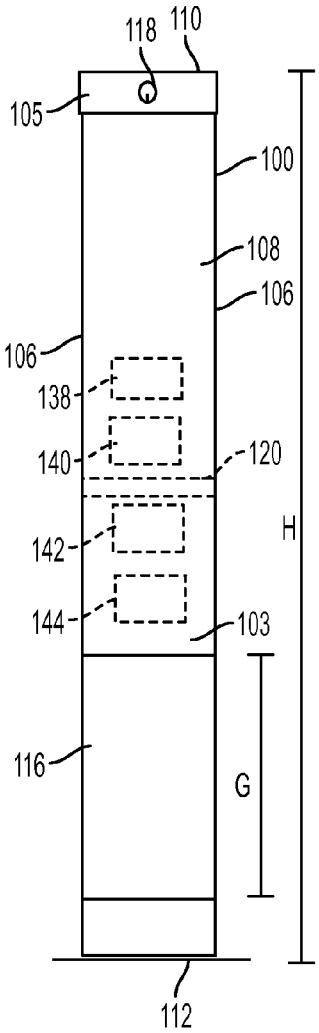
FIG. 1C is a back view of the security kiosk of FIG. 1A.
Figure 1D:
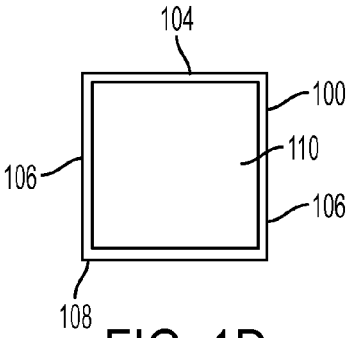
FIG. 1D is a top view of the security kiosk of FIG. 1A.
Figure 1E:
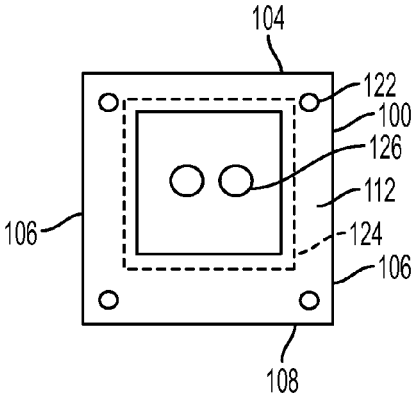
FIG. 1E is a bottom view of the security kiosk of FIG. 1A.
Figure 2A:
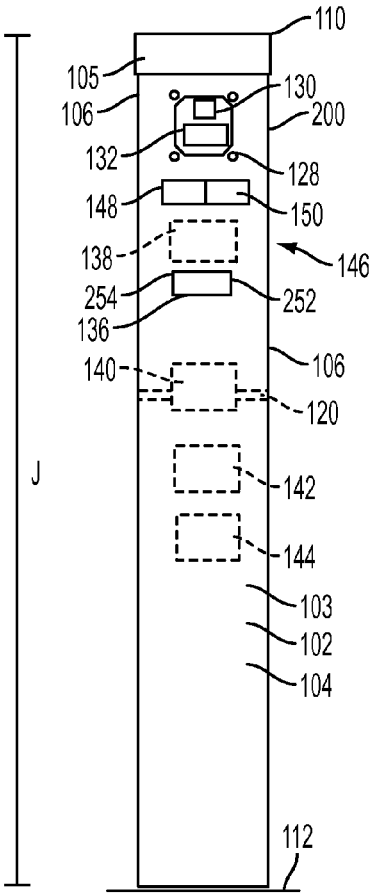
FIG. 2A is a front view of a security kiosk according to a second exemplary embodiment of the present invention.
Figure 2B:
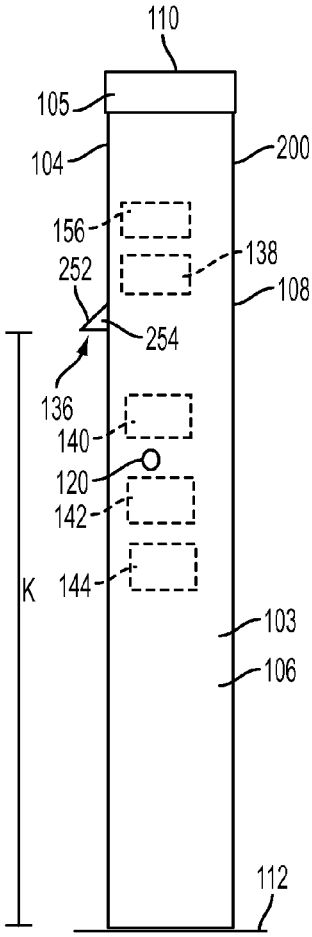
FIG. 2B is a side view of the security kiosk of FIG. 2A.
Figure 2C:
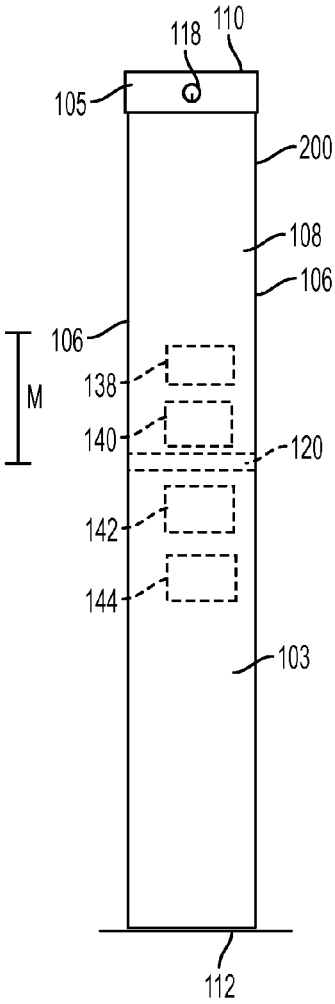
FIG. 2C is a back view of the security kiosk of FIG. 2A.
Figure 2D:
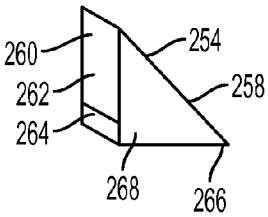
FIG. 2D is a isometric view of a protrusion of the security kiosk of FIG. 2A.
Figure 2E:
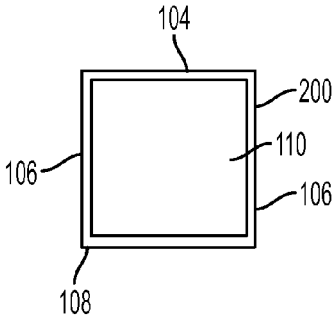
FIG. 2E is a top view of the security kiosk of FIG. 2A.
Figure 2F:
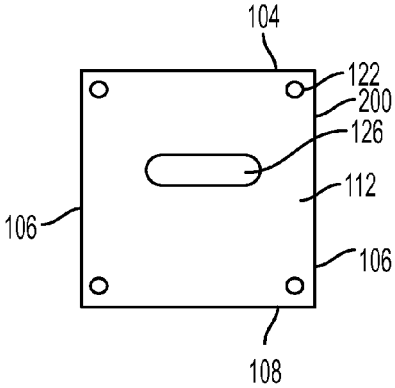
FIG. 2F is a bottom view of the security kiosk of FIG. 2A.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

The present invention generally provides a security kiosk for controlling access to an area, and a system with the kiosk for controlling access to an area, and a method utilizing the security kiosk for controlling access to an area. In general, multiple owners or occupants of units in an area may desire to limit access to the area to the owners or occupants and their approved visitors. The kiosk may be used without the cost of a security officer at an entrance barrier such as a gate or condominium building entrance.

Referring now to FIGS. 1A, 1B, 1C, 1D, and 1E, a first exemplary embodiment of a security kiosk 100 is illustrated. The kiosk 100 may include a housing 102 with a user interface 146. The housing 102 may include a front 104, two sides 106 (only one shown in FIG. 1B), a back 108, a top 110, and a bottom 112. The housing 102 may include a bottom portion 103 and a top portion 105. The top portion 105 may be removable from the bottom portion 103 for interior access. The top portion 105 may be secured to the bottom portion 103 with a lock 118. The back 108 may include an access cover 116 to provide access to the interior of the housing 102. The bottom 112 may include a plate welded to the rest of the housing 102 with a weld 124. The bottom 112 may include bolt holes 122 for bolting the housing 102 to a desired location, and communication line apertures 126 for cable lines connecting portions of the kiosk 100 to remote locations. A rod 120 may extend from side 106 to side 106 to provide rigidity and reinforcement of the housing 102.

The housing 102 may include a recess 114 which may be located on the front 104. A display screen 134 and a visitor ID placement area 136 may be accessible in the recess 114 which may provide protection from direct light and may allow a user to see the display screen 134 more clearly. A light 156 may provide light in the recess 114 when needed. A visitor interface 128 may be located on the front of the housing and include a visitor interface device 130 and a speaker/microphone unit 132 configured to be communicatively connected to a remote location such as a gatehouse or security desk.

A reader 138, a controller 140, a data storage device 142 and a transmitter and receiver unit 144 may be at least partially enclosed by the housing 102. Elements which are at least partially enclosed by the housing 102 are shown with a dashed outline. These elements are shown schematically and not necessarily in the position in which they would be mounted. These elements may be mounted in any location within the housing 102 as would be known in the art. A visitor approach sensor 148 and a camera 150 may be mounted on the top 110 of the housing 102. In alternative embodiments the visitor approach sensor 148 and the camera 150 may be mounted elsewhere on or in the housing 102, or alternatively they may be located remotely of the housing and communicatively linked to the controller 140 in the housing 102.

The controller 140 may include a processor and memory (not shown) as is known in the art. The processor may execute code stored in the memory or received from another device to perform functions which may include controlling access to an area. The controller 140 may be communicatively connected to the visitor interface 128, the display 134, the reader 138, the data storage device 142, and the transmitter and receiver unit 144.

The data storage device 142 may be any memory component which would be known in the art. It may be a separate unit from the controller 140, or it may be integral to the controller 140. The data storage device 142 may contain data on owners and/or occupants of the area and approved visitor data. The approved visitor data may include identities of visitors who are approved for entrance to the area and the dates and times in which these visitors are approved for entry. The data storage device 142 may be configured to be connected to a main data storage unit 406 (shown in relation to FIG. 4) and periodically update the approved visitor data. The data storage device 142 may be communicatively connected to the transmitter and receiver unit 144.

The transmitter and receiver unit 144 may be any transmitter unit and receiver unit for data as would be known in the art. The unit 144 may be a single unit, may be integral to the controller 140, may be a separate transmitter unit and a separate receiver unit, or may be any other configuration as would be known in the art. The unit 144 may be configured to send and receive visitor data, voice data from and to the speaker/microphone unit, and/or any other data as would be known in the art. The unit 144 may be configured to be communicatively connected to receive periodic visitor data updates from a main visitor database for updating the data storage device 142, and voice transmission from a main security center 408 (shown in relation to FIG. 4) for amplification and playing on the speaker/microphone unit 132. The unit 144 may be configured to transmit voice data from the speaker/microphone unit 132 to the main security area. The unit 144 may be a separate physical unit or integral to the controller 140.

The reader 138 may be configured to scan a visitor ID placed in the visitor ID placement area 136. The visitor ID may, for example, include a printed out bar code or other symbol; a bar code, QR code, or other symbol on a phone or other portable electronic device; a near field communication (NFC) capable phone or other portable electronic device; a Driver's License; a card or other identifier with radio-frequency identification (RFID); and/or any other visitor ID which would correspond to the visitor data as would be known in the art. In another example, the reader 138 may scan a visitor's through a fingerprint, eye, or other identifying body feature. The reader 138 may be communicatively connected to the controller 140 to send the scanned data. The controller 140 may interpret the scanned data, or the reader 138 may have an integral processing unit (not shown) which would interpret the data.

The display screen 134 may display information and images for a visitor. The information and images may be communicated from the controller 140, or the display screen 134 may have its' own processing unit.

The housing 102 may have a height from the bottom 112 to the top 110 represented by "H", which may be in an exemplary range of 48-60 inches. The housing may have a distance represented by "C" from the bottom 112 to the recess 114 which may be in an exemplary range of 34-40 inches. The recess 114 may have a height represented by "B" which may be in an exemplary range of 7-9 inches, and a width represented by "A" which may be in an exemplary range of 4-7 inches. The bottom 108 may have a width represented by "D" which may be in an exemplary range of 10-14 inches. The distance between the sides 106 represented by "E" may be in an exemplary range of 6-10 inches. The distance between the front 104 and the back 108 represented by "F" may be in an exemplary range of 6-10 inches. The access door 116 may have a height represented by "G" which may be in an exemplary range of 12-18 inches.

Referring now to FIGS. 2A, 2B, 2C, 2D, 2E, and 2F, a second exemplary embodiment of a security kiosk 200 is illustrated. The second embodiment of the security kiosk 200 may have many of the same features and elements as the first embodiment of the security kiosk 100. These features or elements (which are numbered similarly) will not be described again. Rather only differences and additional elements will be described. In some geographic areas, vandalism of a security kiosk 200 may be a concern. The second embodiment of the security kiosk 200 may assist in preventing loss or damage due to vandalism.

The front 104 of the second embodiment of the security kiosk 200 may not have a recess 114 or a display screen 134. Instead a protrusion 252 may extend from the front 104 defining the visitor ID placement area 136. The protrusion 252 may include a snout 254. The snout 254 may include a protruding front side 258 which may angle out from the kiosk front 104, a mounting side 260 which mounts to the kiosk front 104, a bottom 266, and two sides 268. The mounting side 260 may include a base 264 for mounting and an aperture 262 through which the reader 138 may read a visitor ID placed in the visitor ID placement area 136. The bottom 266 may be open and the visitor ID placement area 136 may be right below the bottom 266. The second embodiment of the kiosk 200 may not have an access cover 116 on the back 108.

The housing 102 may have a height from the bottom 112 to the top 110 represented by "J", which may be in an exemplary range of 42-54 inches. The housing may have a distance represented by "K" from the bottom 112 to the bottom 266 of the snout 254 which may be in an exemplary range of 33-43 inches. The distance from the bottom 266 of the snout 254 to the rod 120 may be represented by "M" and may be in an exemplary range of 10-14 inches.

Figure 3B:
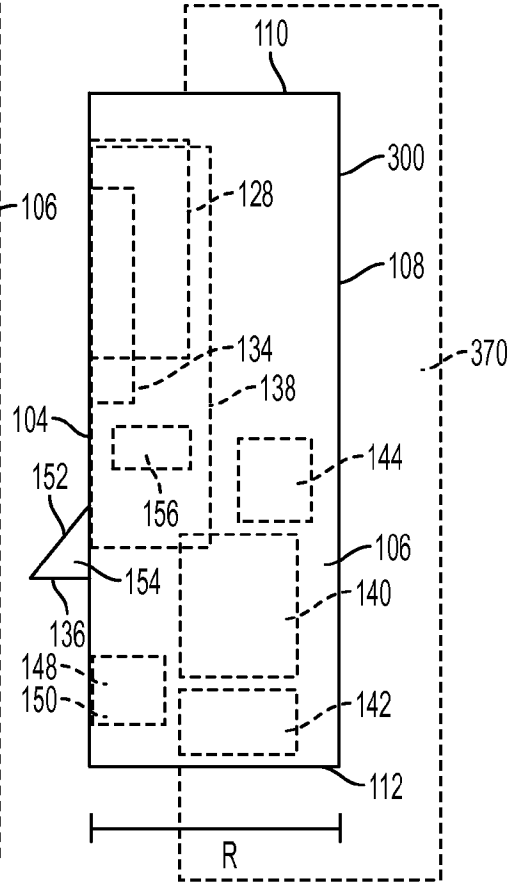
FIG. 3B is a side view of the security kiosk of FIG. 3A.
Figure 3A:
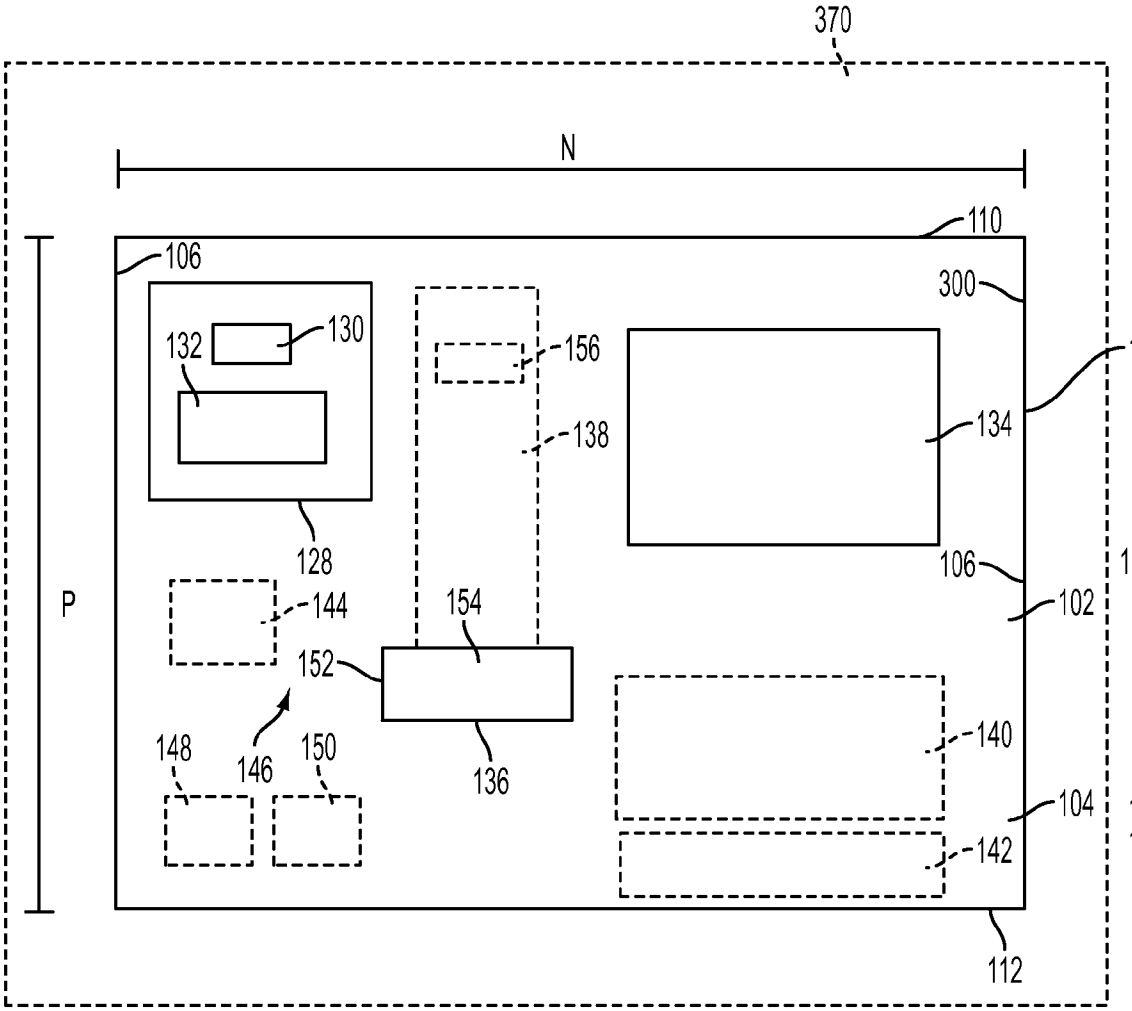
FIG. 3A is a front view of a security kiosk according to a third exemplary embodiment of the present invention.

Referring now to FIGS. 3A and 3B, a third exemplary embodiment of a security kiosk 300 is illustrated. The third embodiment of the security kiosk 300 may have many of the same features and elements as the first embodiment of the security kiosk 100. These features or elements (which are numbered similarly) will not be described again. Rather only differences and additional elements will be described. In some embodiments, the area to which access is being controlled may be a building with multiple tenants/occupants/owners, such as, for example, a condominium, apartment building, or office building. In this type of embodiment, the security kiosk 300 may be located in a recess in a wall 370 in a lobby or other public access area.

In comparison with the first kiosk 100 embodiment, the third kiosk 300 embodiment may not have a recess 114, but may have the protrusion 252 which may include the snout 254. Instead of being self-standing, the kiosk 300 may be designed to fit into the wall 370 recess and be supported by the wall 370 recess.

The housing 102 may have a height from the bottom 112 to the top 110 represented by "P", which may be in an exemplary range of 10-15 inches. The housing 102 may have a width from one side 106 to the other side 106 represented by "N" which may be in an exemplary range of 13-20 inches. The housing 102 may have a depth from the front 104 to the back 108 represented by "R" which may be in an exemplary range of 3-6 inches.

Figure 4:
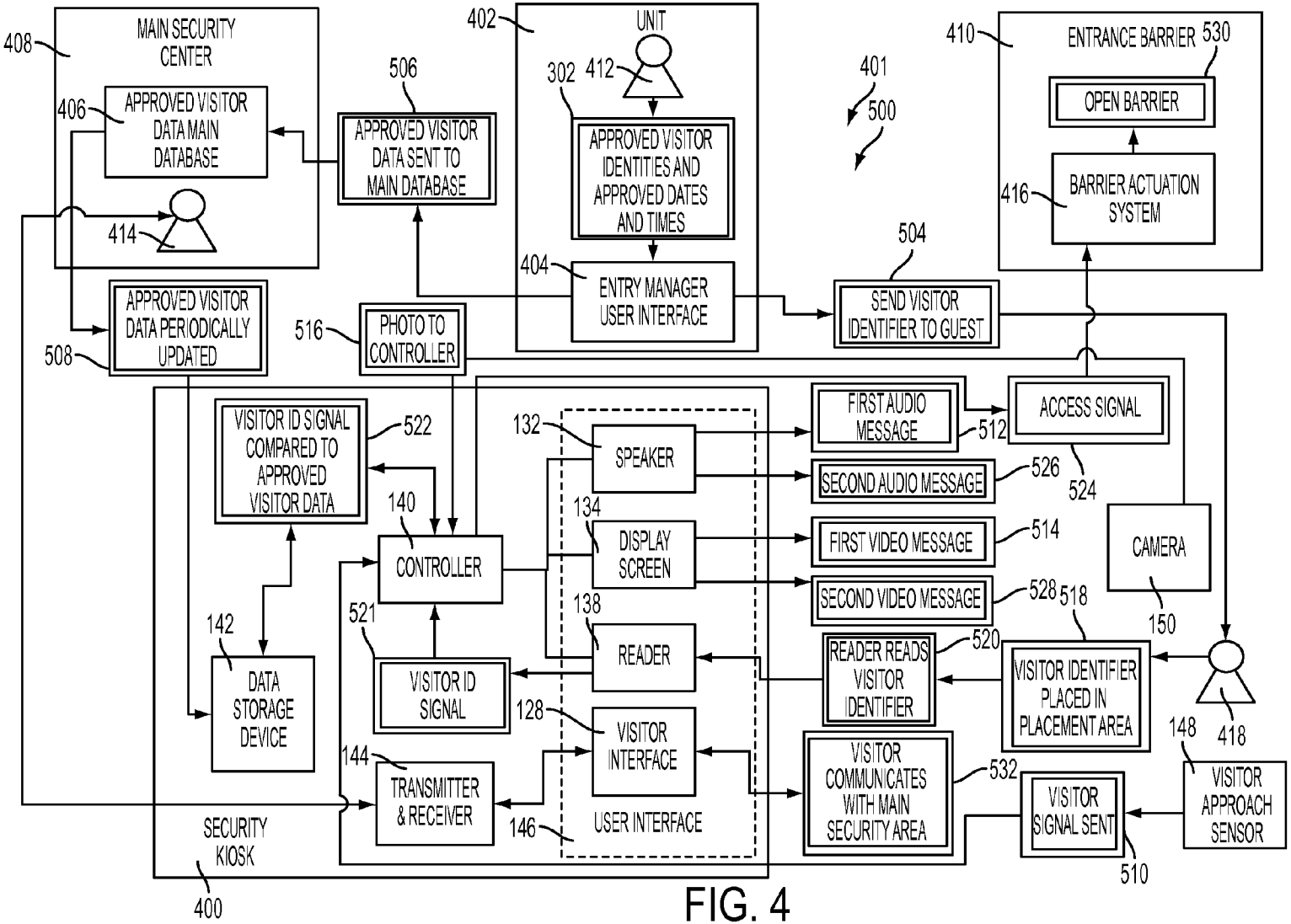
FIG. 4 is a schematic and flow chart of an exemplary system and method for controlling access to an area according to an exemplary embodiment of the present invention.

Referring now to FIG. 4, a schematic of an exemplary system 401 for and method 500 of controlling access to an area is illustrated. The system 401 may include a kiosk 400. The kiosk 400 and exemplary elements thereof are numbered similarly to the embodiments of the kiosk 100, 200, 300 illustrated in the preceding Figures. Exemplary elements which may be included in the system 401 are numbered in the 400 series and shown in a box with a single line border. Exemplary steps which may be included in the method 500 are numbered in the 500 series and are shown in a box with a double line border.

In addition to the kiosk 400, the system 401 may include a unit 402, a main security center 408, and an entrance barrier 410. In the exemplary system 401 illustrated, the visitor approach sensor 148 and camera 150 are shown separate from the kiosk 400. For example, the visitor approach sensor 148 may be a pressure sensor in a drive leading to a gate of a gated community utilizing the kiosk 400. When the visitor's car pulls up to the kiosk 400, the pressure sensor may send a signal to the controller 140 that a visitor may be approaching. In other embodiments, the visitor approach sensor 148 may be mounted on the kiosk 400 and/or may be a motion detection sensor. An owner/tenant/occupant 412 of a unit, a security officer 414, and a visitor 418 are also illustrated in the schematic.

The unit 402 may be an individual unit in a multi-unit area for which controlling access is desired. In non-limiting examples, the unit 402 may include a home in a gated community, a condominium unit in a condominium building, and/or an office in an office building or park. The unit 402 may include an entry manager user interface 404 (for example a personal computer) through which an owner/tenant/occupant 412 may enter approved visitors 418 and date and time periods when the visitors 418 are approved for access. The entry manager user interface 404 may be communicatively connected to and configured to send visitor approved data to an approved visitor main database 406. The entry manager user interface 404 may be configured to send a visitor identifier, such as for example, a bar code, a password, or another symbol to an approved visitor 418. In other embodiments the entry manager user interface 404 may include other electronic devices such as tablets or phones, a phone access system, or any other entry manager user interface 404 which would be known in the art for entering visitor data.

The main security center 408 may be a gatehouse or an office from which access to an area may be controlled. In non-limiting examples, the main security center 408 may include the gatehouse for a gated community or office park, the security office of a condominium building or office building, or a remote site through which security is controlled for an area. The main security center 418 may include the approved visitor main database 406 which may store and update approved visitor data. In some embodiments the main database 406 may be located in a different location than the security center 408. The security center 408 may be configured to transmit and receive voice signals from the kiosk 400 such that a security officer 414 may verbally communicate with a visitor 418 at the kiosk 400. The main database 406 may be communicatively connected to the data storage device 142.

The entrance barrier 410, may be a gate, a door, or other device(s) which may selectively bar entry to an area. In non-limiting examples, the entrance barrier 410 may include a main or secondary gate to a gated community or office park, a main or secondary door to a condominium building or an office building, or an elevator to select floors of a condominium or office building. If the barrier 410 is a door, the door may include a swing type door, a turn stile door, a sliding door (side to side or up and down), or any other type door. The entrance barrier 410 may include a barrier actuation system 416 which may selectively open and close the entrance barrier 410 in response to an access signal. For example, the barrier actuation system 416 may lift and then let down, or swing open and shut, a gate to allow visitors 418 in and out of a gated community. In another non-limiting example the barrier actuation system 416 may unlock and lock a door, or open and close a door in a condominium building.

The method 500 of controlling access to an area may start with the owner/tenant/occupant 412 of the unit 402 entering approved visitor data on the entry manager user interface 404, the approved visitor data including approved visitor identities and corresponding approved date and time barrier entry periods (step 502). When new visitor data is entered, the entry manager user interface 404 may send a visitor 418 an identifier which the visitor 418 may use to gain entry to the controlled area through the entrance barrier 410. The identifier may, for example include a bar code or other symbol which may be printed by the visitor 418 or displayed on an electronic device such as a phone (step 504). The entry manager user interface 404 may send the visitor data entered to the approved visitor main database 406 where it may be stored and/or previous approved visitor data updated (step 506). Approved visitor data in the data storage device 142 of the kiosk 400 may be periodically updated from the approved visitor main database 406, such that new approved visitor data entered in the entry manager user interface 404, may be stored in the data storage device 142. The approved visitor data may, for example, be updated every fifteen (15) minutes (step 508).

When a visitor 418 approaches the kiosk 400 to gain entry into the controlled area through the entrance barrier 410, a visitor signal is sent from the visitor approach sensor 148 to the controller 140 (step 510). The controller 140 may send instructions and data to the speaker 132 to play a first audio message greeting the visitor 418 and/or instructing the visitor 418 to place their visitor identifier in the visitor id placement area 136 (step 512). Concurrently or alternatively the controller 140 may send instructions and data to the display screen 134 to play a first video message (step 514). For example, a digital assistant may appear on the screen while the first audio message is playing. The camera 150 may take a photograph of the visitor 418 and may send the photograph to the controller 140, and/or the main security center 408 (step 516). The controller 140 may store the photograph in the data storage device 142 or may transmit it elsewhere.

The visitor 418 may place their visitor identifier in the visitor id placement area 136 (step 518) and the reader 138 may read the identifier (step 520) and send a signal indicative of the identity of the visitor 418 to the controller 140. The visitor identifier may be a bar code or other symbol, or could be a driver's license or other known personal ID.

The controller 140 may compare the identity of the visitor to the approved visitor data (step 522), and if the visitor 418 is an approved visitor at the current time on the current date, the controller may send an access signal (step 524) to the barrier actuation system 416 and the barrier actuation system 416 may open the entrance barrier 410 (step 530) to allow the visitor 418 into the controlled area.

The controller 140 may also send instructions and data to the speaker 132 to play a second audio message (step 526) as a function of the comparison of the identity of the visitor 418 with the approved visitor data. If the visitor 418 is approved for entry the second audio message may indicate this. If the visitor 418 is not approved for entry, the second audio message may indicate this and inform the visitor 418 that they can reach the main security center 408 through use of the visitor interface 128.

Concurrently to or alternatively to the second audio message, the controller 140 may also send instructions and data to the display screen 134 to play a second video message (step 528) as a function of the comparison of the identity of the visitor 418 with the approved visitor data. If the visitor 418 is approved for entry the second video message may indicate this. If the visitor 418 is not approved for entry, the second video message may indicate this and inform the visitor 418 that they can reach the main security center 408 through use of the visitor interface 128. The second audio message and the second video message may play simultaneously, for example, in an audio/visual representation of a digital assistant.

If the visitor 418 is denied entry, they may use the visitor interface 128 to contact the main security center for help (step 532). The visitor interface 128 may include a visitor interface device 130, such as a button, or a touch area on a touchscreen which the visitor 418 may use to activate the speaker/microphone unit 132 to talk to the security officer 414 or other person in the main security center 408. The visitor interface 128 may also send a signal to the main security center 408 such that the security officer 414 or other person is aware that a visitor 418 requires their assistance. The security officer 414, may for example, direct the visitor 418 to a main gate or entrance where an attendant may assist them.

It should be understood, of course, that the foregoing relates to exemplary embodiments of the invention and that modifications may be made without departing from the spirit and scope of the invention as set forth in the following claims.

I claim:

1. A method of controlling access to an area, comprising:

entering approved visitor data on an entry manager user interface, the approved visitor data including approved visitor identities and corresponding approved date and time barrier entry periods;

periodically updating and storing in a storage device located in a security kiosk the approved visitor data;

playing at least one of an audio and video welcome message on a visitor communication device in the security kiosk;

scanning a visitor identifier with a visitor identification reader located in a security kiosk and generating a visitor identification signal indicative of a visitor's identity;

comparing the visitor's identity with the approved visitor identities in the approved visitor data stored in the storage device and the present time and date with the corresponding approved date and time gate entry periods;

generating an open barrier signal when the visitor identity and present time and date match data in the approved visitor data; and playing at least one of an audio and video entry status message on the visitor communication device.

2. A security system for controlling access to an area, comprising:

an entry manager user interface configured to allow entry and updates of approved visitor data, the approved visitor data including approved visitor identities and corresponding approved time and date entry periods;

an approved visitor data main database communicatively connected with the entry manager user interface and configured to store and update approved visitor data;

an entrance barrier to allow or bar access through an entrance, the entrance barrier including an entrance barrier actuator, the entrance barrier actuator configured to open and close the entrance barrier to selectively allow or bar access through the entrance in response to an access signal;

a security kiosk communicatively connected to the main database and the entrance barrier actuator, and including;

a housing including an exterior with a recess;

a visitor identification reader located in the recess and configured to read a visitor identifier and produce an visitor identification signal indicative of a visitor's identity;

a data storage device located at least partially in the housing and configured to store approved visitor data, and update the approved visitor data from the main database at periodic intervals;

a controller communicatively connected to the visitor identification reader and the data storage device, and configured to generate an access signal as a function of comparing the visitor's identity with the approved visitor data, the controller located at least partially in the housing; and a visitor interface device including a user interface located on the housing exterior, the visitor interface device configured to produce and transmit a visitor signal inputted on the user interface.

* * * * *